United States Patent [19]

Hildebrandt

[11] Patent Number: 4,681,320

[45] Date of Patent: Jul. 21, 1987

[54] TOP AND BOARD THEREFOR

[76] Inventor: Edmund Hildebrandt, 6 Cedar St., Clinton, Mass. 01510

[21] Appl. No.: 845,548

[22] Filed: Mar. 28, 1986

[51] Int. Cl.[4] ..... A63B 67/14; A63B 9/16

[52] U.S. Cl. ..... 273/109; 446/261; 446/263

[58] Field of Search ..... 446/261, 263; 273/108, 273/109, 236, 110, 112

[56] References Cited

U.S. PATENT DOCUMENTS

| | | | |
|---|---|---|---|
| 836,958 | 12/1906 | Békéfi | 446/261 |
| 1,130,461 | 3/1915 | Zolper | 273/109 |
| 1,206,942 | 12/1916 | Swanstrom | 446/261 |
| 1,668,695 | 5/1928 | Pfaff | 446/263 |
| 1,771,489 | 7/1930 | Dochnal | 446/263 |
| 1,841,566 | 1/1932 | Zaurrini | 446/263 |
| 2,595,823 | 5/1952 | Wassenaar | 446/263 |
| 3,044,212 | 7/1962 | Lancaster | 446/261 |
| 3,863,925 | 2/1975 | Torgow | 446/261 |
| 3,933,356 | 1/1976 | Torgow | 273/109 |
| 4,257,605 | 3/1981 | Bancroft | 273/109 |

FOREIGN PATENT DOCUMENTS

| | | | |
|---|---|---|---|
| 462784 | 3/1937 | United Kingdom | 273/109 |

*Primary Examiner*—Richard C. Pinkham
*Assistant Examiner*—Gary Jackson
*Attorney, Agent, or Firm*—Charles R. Fay

[57] ABSTRACT

A spinning top toy and game including a top and a game board on which the top is spun, the game board being hand held and used to manipulate and travel the top along an outline on the board. The board is folded in the middle and can be used flat or with the two parts defined by the fold at angles to each other.

3 Claims, 6 Drawing Figures

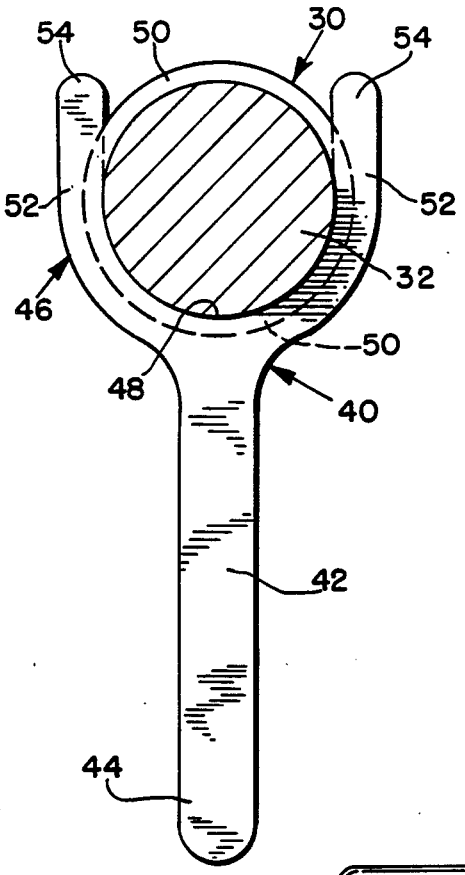
FIG. 4
FIG. 5
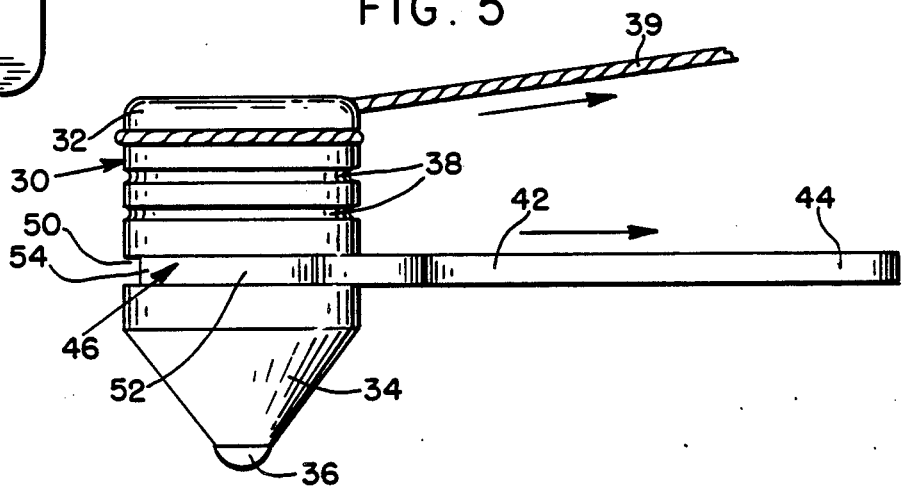
FIG. 6
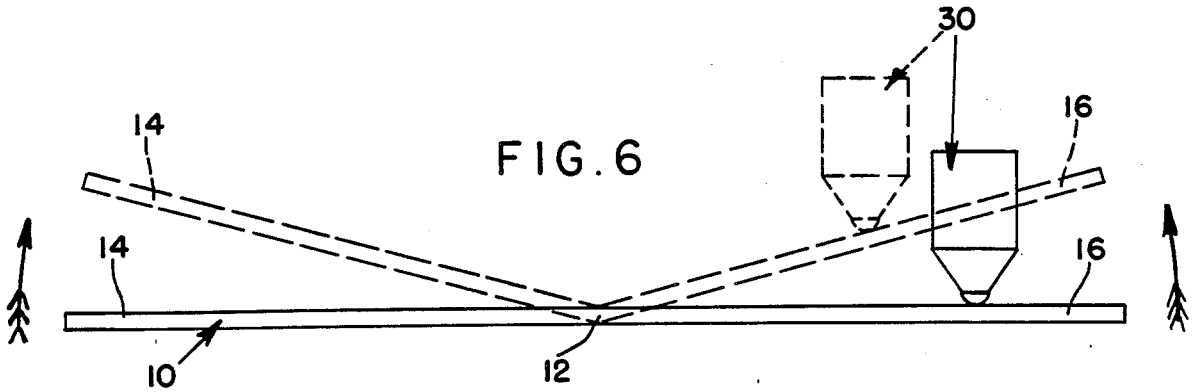

TOP AND BOARD THEREFOR

FIELD AND BACKGROUND OF THE INVENTION

This invention resides in a spinning top energized by a cord and a game board to spin the top on. The board is generally flat and manipulatable and provides the top spinner a game in that by correct manipulation of the board, the top is continually re-energized and may be kept spinning for long periods of time past the end of the original impetus given by the cord. Thus, a competitive game is provided, rather than simply a toy.

SUMMARY OF THE DISCLOSURE

The top may be of any suitable material, such as wood or plastic, and comprises a solid cylindrical portion having a series of circumferential circular spaced grooves to better receive and store the cord about the cylindrical part, and a wider and deeper single groove for a top holder adjacent the inner end of the cylindrical part of the top which at the remainder thereof is conical, terminating in a reinforced point.

The top holder is in general Y-shaped, having a pair of legs with a semi-circular junction, to snugle fit in the larger groove, the leg of the Y forming a handle. Thus, the top may be placed in the holder, wound with the cord, the point placed on the board, and the cord pulled. Also, the top may be first wound and then placed in the holder. By using the holder, the attempt to spin the top is always successful on the board.

The board is hinged, preferably simply diametrically to provide two playing surfaces that may be held manually by the player in co-planar condition, or at varying angles to each other, so that the top can spin down on part of the board and up the other part, while the angle between the board parts is varied, and if desired, the entire board is varied in relation to the horizontal. By well chosen manipulation, the top may be kept going long past the interval that would result merely from spinning the top on a fixed board. The board could be folded more than once to complicate the game.

The board also is provided with a game surfaces, such as a target or the like, but preferably a spiral track takes up the major surface of the board, so that the player can start the top from the center and by board manipulation, cause the top to travel the course of the track, and competition is invited to time the full course of the top; or, credits may be given for lengths properly achieved before mishap to the top or too wide a divergance from the track occurs. A referee may be used. Other shapes of track can be used also. Thus games of skill are provided and competitions made, and using the holder, false starts and much fumbling are avoided.

BRIEF DESCRIPTION OF THE DRAWINGS

FIG. 4 is a sectional view of a top with a plan view of a top holder;

FIG. 5 is an elevational view of a top spinning and the cord in the act of being pulled off, and the holder about to be removed; and FIG. 6 is an edge view of a game board in use and showing an angular placement in dotted lines.

PREFERRED EMBODIMENT OF THE INVENTION

Figure 1:
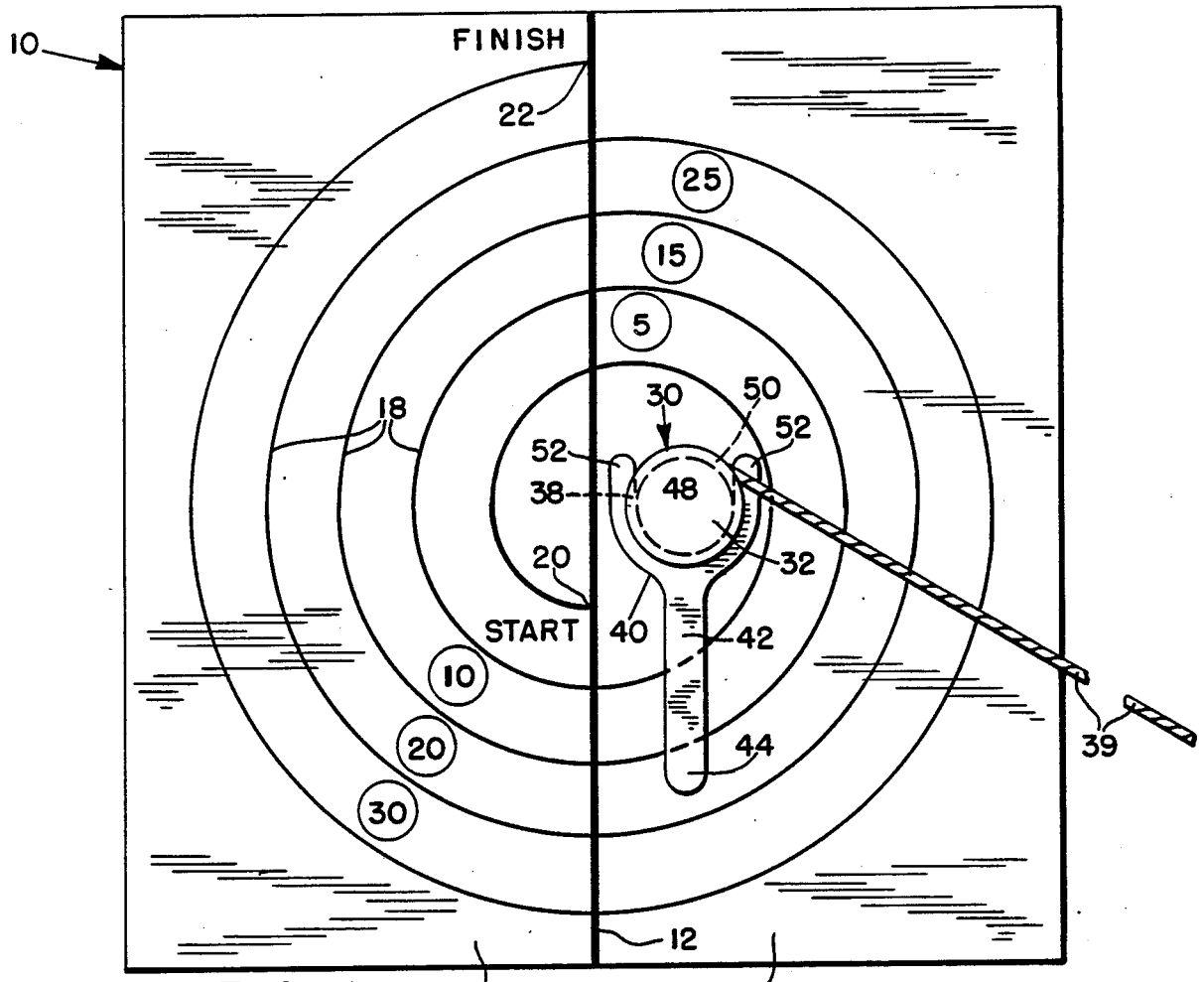
FIG. 1 is a plan view of a game board and top thereon.

A generally square or rectangular game board 10 is preferably hinged as at 12 to form two like parts 14, 16 that may be laid out flat in co-planar relation, or positioned at a relative angle, or folded to half size for transmission and storage. The board is preferably imprinted with a design to indicate a line to follow with the top, or other markings, as will be described below. In this case, the two parts of the board join in presenting a spiral 18, and the play is to follow this line from a start at 20 to a finish at 22. Various linearly arranged numerals may be utilized to show how far the top was made to go before falling. An inch rule may be used, or simply figures, as shown.

The top 30 itself is preferably wood, plastic, etc., and includes a cylindrical portion 32 and a conical portion 34, the latter terminating in a metal or similar point 36 on which the top spins. The cylindrical portion 32 is preferably provided with a series of spaced circular grooves 38 which aid in receiving and holding cord 39 as it is wrapped about the top prior to the spinning actuation, by pulling the cord.

Since the board 10 is plane, and has no partitions, fences, side barriers, etc., it is possible to use the holder 40, which greatly facilitates starting the top spinning. This holder is a flat tool having a handle 42 with a free end 44 and a fork 46 at the other end. Fork 46 has a semi-circular bottom 48 that just fits the circular groove 50 in the top, groove 50 being wider than grooves 38. The width of groove 50 accommodates the arms 52 of the handle, these arms extending from the semi-circular bottom 48 and having short sections 54 that are straight and parallel and facilitate engagement of arms 52 with groove 50.

Figure 2:
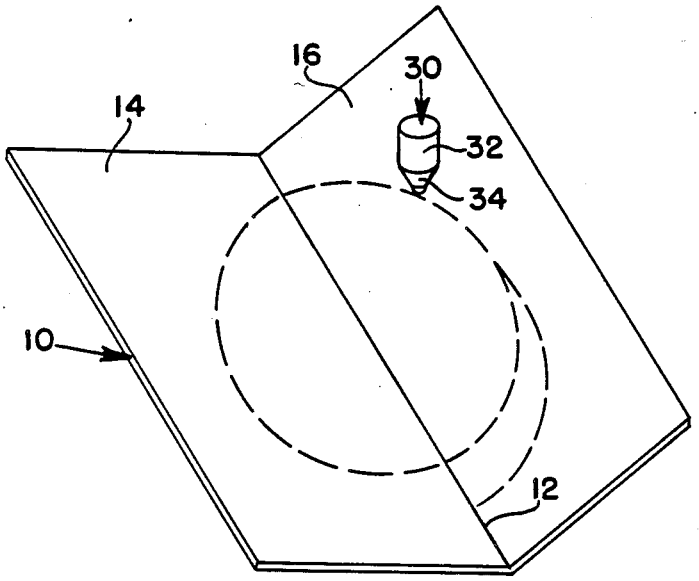
FIG. 2 is a perspective view of a game board in use when the parts are at an angle.
Figure 3:
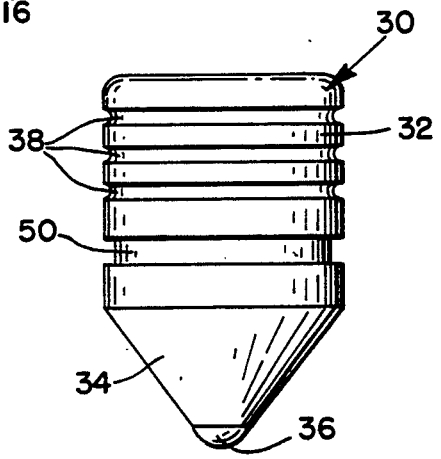
FIG. 3 is an elevational view of the top.

With the game board open and flat upon a table or the floor, the top is wound with the cord, set on the board, being held with one hand grasping the handle 42 of the top holder as in FIG. 1. The other hand pulls the cord smartly and the holder is pulled back. The player sets down the cord and holder and grasps the game board at its edges and manipulates it with the top spinning on it. Such manipulation in general has the object of moving the spinning top down an incline, simply by tilting the board as a unit, or by tilting one half of the board, either part 14 or part 16, FIG. 2 or FIG. 6. In order to follow the spiral track on the board, it is necessary to rotate the board, or tilt it during a rotating motion. Skill in this game is derived from dexterous practice, and proper manipulation of the board can keep the top spinning indefinitely, as it gains momentum going down hill.

Another game is to provide two or more persons, even up to a dozen, with separate boards, and pass the spinning top from one to another, e.g., in a circle. Anyone who drops the top, or fails to keep it spinning is "out".

This invention is seen to present a toy, but more important, a game of skill in following the track, or in keeping the top spinning as long as possible, i.e., timed top spinning. Also, the top is actuated by a practically fool-proof tool and cord, so that false starts are obviated. Other ways of using, enjoying and competing will present themselves to players.

I claim:

1. A toy spinning top and a supporting game board for the top, comprising a top having a cylindrical body with a downwardly tapering portion terminating in a spinning point, means to spin the top, a diagram on the game board indicating a proposed path for the top, the game board being manipulatable to incline it to a selective inclinations relative to the horizontal with the top spinning thereon, said game board being bare and plain and lacking (handles or) edge fences, whereby the top is more easily spun thereon with a single cord wrapped thereon with respect to the cylindrical portion of the top (.), the game board being foldable on a diametric line, so that the top may be energized with the entire game board co-planar and horizontal, and the folded parts of the board may be placed at selectively variable angles while the top spins on either part.

2. The toy of claim 1 wherein the game board is imprinted with a track for the player to cause the top to follow (.), the track appearing on both fold parts.

3. The toy of claim 2 wherein the track is a spiral.

* * * * *